United States Patent [19]

Skach, Jr.

[11] 4,359,344

[45] Nov. 16, 1982

[54] SALT REMOVAL FROM MG GRANULES

[75] Inventor: Edward J. Skach, Jr., Freeport, Tex.

[73] Assignee: The Dow Chemical Company, Midland, Mich.

[21] Appl. No.: 312,051

[22] Filed: Oct. 16, 1981

[51] Int. Cl.[3] ..... B08B 3/08

[52] U.S. Cl. ..... 134/2; 75/0.5 R; 134/25.1; 134/29

[58] Field of Search ..... 134/25,1, 2, 29; 75/0.5 R, 0.5 B, 0.5 C, 67 R, 67 A; 427/156, 216; 241/20

[56] References Cited

U.S. PATENT DOCUMENTS

| | | | |
|---|---|---|---|
| 2,151,457 | 3/1939 | Williams | 134/28 X |
| 2,718,463 | 9/1955 | Clarke | 134/2 X |
| 3,881,913 | 5/1975 | Barannik et al. | 75/0.5 R X |
| 4,182,498 | 1/1980 | Goldberger et al. | 241/24 |
| 4,186,000 | 1/1980 | Skach et al. | 75/67 R X |

*Primary Examiner*—Marc L. Caroff
*Attorney, Agent, or Firm*—W. J. Lee

[57] ABSTRACT

Salt is removed from salt-coated or salt-contaminated Mg particles by leaching the salt with an alkaline aqueous wash, e.g., NaOH, then removing water from the Mg particles by using a water-miscible, inert, evaporatable, non-aqueous liquid, e.g. acetone.

11 Claims, No Drawings

SALT REMOVAL FROM MG GRANULES

BACKGROUND OF THE INVENTION

Salt-coated Mg granules are prepared in various ways, such as disclosed, e.g., in U.S. Pat. Nos. 3,881,913; 4,186,000; and 4,182,498.

U.S. Pat. No. 3,881,913 discloses a hydrochemical treatment of salt-coated Mg granules using a 1-10% solution of alkali metal bichromate (viz. potassium bichromate) at 10°-35° C. with the weight ratio of granules to solution being from 1:2 to 1:20. The hydrochemical treatment removes a substantial amount of the salt from the Mg.

U.S. Pat. Nos. 4,186,000 and 4,182,498 disclose the preparation of Mg granules which each have a thin protective salt coating. The salt coating helps protect the Mg metal from hydrolysis or oxidation by air, especially wet air.

It is desired to produce substantially salt-free Mg particles, for applications where salt is desirably absent, by removing salt from salt-coated Mg particles.

It is an object of the present invention to substantially remove salt from salt-coated Mg particles, regardless of their size and shape, in a manner which substantially avoids hydrolysis of the Mg particles, or of leaching away or reacting away a significant amount of the Mg metal.

A further object is to substantially remove the salt from salt-coated Mg particles by means which leave the Mg particles with a thin protective passivated surface.

SUMMARY OF THE INVENTION

An alkaline aqueous wash of the salt coating from salt-coated Mg granules, followed by washing with a water-miscible, inert, non-aqueous liquid, provides substantially salt-free Mg granules without hydrolyzing a substantial amount of the Mg metal. Salt-free Mg particles so-produced are substantially protected from subsequent hydrolysis by atmospheric moisture due to the thin protective layer of passivated Mg on the surface of the particles.

DETAILED DESCRIPTION OF THE INVENTION

The salt-coated Mg particles for use in the present invention includes, but is not limited to, such salt-coated Mg particles as may be prepared in accordance with the above-discussed U.S. Pat. Nos. 3,881,913; 4,186,000; and/or 4,182,498. Of special interest, because of economics, are salt-coated or salt-contaminated Mg particles which are found in pulverized or ground-up Mg cell sludges or Mg casting slags or Mg alloy casting slags. In the present invention it is not necessary that the Mg particles be of any particular size or shape. For some applications, such as lance-injections into molten ferrous melts, the users of the Mg particles generally require a relatively consistent size range and roundness, but for other applications, such as remelting for alloying or for casting, the sizes and shapes of the Mg particles may be very diverse.

Though the descriptions in this disclosure are generally directed to Mg particles, it will be apparent to practitioners of the relevant arts that Mg alloys, where Mg is the predominant ingredient, are also appropriate.

In general, the process comprises use of an alkaline aqueous solution to leach the salt away from the Mg particles, then washing away the aqueous solution using a water-miscible organic liquid, and evaporating the organic liquid leaving the Mg particle dry and substantially free from salt contamination.

It is within the purview of the present invention to beneficially grind or pulverize salt-agglomerated Mg particles in the presence of copious amounts of the alkaline aqueous solution in instances wherein the salt-contaminated Mg particles are in clusters, thereby breaking up the clusters, then proceed with the leaching and drying operations.

The alkaline aqueous solution may be ammonium hydroxide or an alkali metal hydroxide, especially NaOH.

The pH of the alkaline aqueous solution during the leaching operation must be great enough to avoid having the solution become acid by way of the salt anions which result from solubilizing the salt and also to avoid the rapid hydrolysis of Mg which is encountered when the pH is not alkaline enough. It is contemplated that the pH during leaching must be at least about 10 pH, preferable at least about 11 pH. A highly alkaline pH of 13 or more is operable, but there are no additional benefits in going to such highly alkaline pH's which are commensurate with the added expense. Thus for good operation at favorable economics, a pH in the range of about 11 pH to about 11.5 pH is preferred.

Though a single batchwise leaching step is operable, if there is enough alkaline aqueous liquid to solubilize substantially all the salt, it is preferred that two or more leaching steps be employed. A given quantity of the aqueous solution gives better efficiency if applied as two or more leaching steps rather than all at once in a single step. It is not necessary that the leaching be done batchwise, as the leaching may be performed quite well in a vessel, such as a wash column, where a given quantity of the aqueous liquid is passed through a batch of Mg particles until the quantity is expended.

The temperature employed for the leaching operation may be, conveniently, at ambient temperature, but may be anywhere in the range of about 0° C. to about 100° C., preferably about 20° C. to about 40° C., the higher temperatures being effective in speeding the dissolution of the salts in the alkaline solution.

Following the alkaline leaching step it is preferred, but optional, to use enough water as a wash to remove or reduce the alkalinity. However, once the alkalinity has been reduced there may be some tendency for the small amount of salt values (if any remain) to form acids which can attack the Mg and promote hydrolysis. If the optional water wash step is used, then removal of the water from the Mg particles by using a water-miscible, (but otherwise inert) non-aqueous organic liquid should be done right away.

Following the leaching operation, or the water-washing (if used) a water-miscible, inert organic liquid is used to remove water from the Mg particles. By "inert" it is meant here that the organic liquid has little or no tendency to form reaction products with the Mg particles. The temperature at which the organic liquid washing operation is performed may be, conveniently, at ambient temperature, though virtually any temperature between the freezing point and the boiling point of the organic liquid may be used, preferably a temperature between about 20° C. and 40° C. (or the boiling point, if lower).

The organic liquid to be used is one which, as stated above, is essentially non-reactive with the Mg and is one which can be readily evaporated from the Mg particles. Acetone is conveniently and preferably used because it is easily and economically available, is very miscible with water (even alkaline water), is easily evaporated from the Mg particles, and can be easily processed or purified sufficiently to be recycled in the process. Other organic liquids having such properties are contemplated as being within the purview of the present invention.

The final wash liquid, instead of being called an "organic liquid" can also be referred to as a "non-aqueous" liquid, the importance of it being that it will remove the water from the Mg particles, not introduce any significant amount of side-reactions, and be readily and substantially evaporated from the Mg particles.

EXAMPLE

Into a stirred vessel was mixed 175 ml. of 4.0 N NaOH diluted with 3500 ml. of de-ionized water (pH about 11), and 150 grams of salt-coated Mg particles (the particles comprising about 85–90% Mg metal). The mixture was stirred at ambient temperature for about 15 minutes, then the liquid was decanted, the Mg particles still remaining wet with caustic. To the Mg particles was added a second quantity of alkaline water (90 ml. 4.0 N NaOH in 3500 ml. of D.I. water) and the mixture was stirred at ambient temperature for about 15 minutes. The liquid was decanted and a third wash quantity (similar to the second) was stirred with the Mg particles for about 15 minutes.

The Mg particles were collected on a 65 mesh screen, rinsed with 3500 ml. of D.I. (de-ionized) water, rinsed well with acetone (total about 500 ml.) to remove water, and dried under vacuum at about 100° C. overnight. The acetone wash was collected for processing and re-cycle.

The dried Mg particles were found to be salt-free and the surfaces were passivated sufficiently so that when exposed to moist ambient air no significant amount of hydrolysis was found to result therefrom. By analysis and observation it was concluded that the surfaces of the particles were passivated by the presence thereon of a molecular layer of MgO.

The foregoing illustrates particular embodiments but the invention contemplated here is not limited to the expressed embodiments and the purview of the invention is limited only by the following claims.

I claim:

1. A process for removing a salt coating from Mg particles, said process comprising (a) leaching said salt coating from said Mg particles by contacting said particles with an alkaline aqueous wash solution at a pH of at least about 10 for a period of time sufficient to dissolve said salt coating, (b) draining said aqueous wash from said Mg particles, and (c) removing residual aqueous wash from said Mg particles by contacting said particles with a water-miscible, evaporatable, inert, non-aqueous liquid.

2. The process of claim 1 wherein following step b, but prior to step c there is performed a water washing of the Mg particles to reduce the alkalinity residue on the Mg particles, followed shortly thereafter by step c.

3. The process of claim 1 wherein the leaching is done at a pH of at least about 11.

4. The process of claim 1 wherein the leaching is done at a pH of about 11 to about 11.5.

5. The process of claim 1 wherein the alkaline aqueous wash comprises ammonium hydroxide or an alkali metal hydroxide.

6. The process of claim 1 wherein the alkaline aqueous wash comprises KOH.

7. The process of claim 1 wherein the alkaline aqueous wash comprises NaOH.

8. The process of claim 1 wherein there is performed, after step c, the additional step of evaporating the inert non-aqueous liquid from the Mg particles.

9. The process of claim 1 wherein the inert non-aqueous liquid is acetone.

10. The process of claim 1 wherein the leaching is done at a temperature in the range of about 0° C. to about 100° C.

11. The process of claim 1 wherein the leaching is done at a temperature in the range of about 20° C. to about 40° C.

* * * * *